United States Patent [19]

Reuther

[11] 4,216,958

[45] Aug. 12, 1980

[54] TENSIONING DEVICE FOR A GYMNASTICS APPARATUS

[76] Inventor: Richard Reuther, Philipp-Stempel-Str. 3, Ludwigshafen am Rhein, Fed. Rep. of Germany, 6700

[21] Appl. No.: 773,697

[22] Filed: Mar. 2, 1977

[30] Foreign Application Priority Data

Mar. 10, 1976 [DE] Fed. Rep. of Germany ..... 2609898

[51] Int. Cl.[2] ..... A63B 5/00; A63B 7/00

[52] U.S. Cl. ..... 272/109; 24/136 L; 242/147 R; 24/122.6

[58] Field of Search ..... 272/62, 63, 65, 76–78, 272/142, 109; 188/65.1; 66/146; 242/147 R; 211/119.01; 24/136 L, 136 R, 122.6; 52/148

[56] References Cited

U.S. PATENT DOCUMENTS

| | | | |
|---|---|---|---|
| 936,156 | 10/1909 | Parker | 24/136 R |
| 2,641,810 | 6/1953 | Gasnik | 24/122.6 X |
| 3,397,882 | 8/1968 | Reuther | 272/63 |
| 4,059,333 | 11/1977 | Mixon | 24/136 R X |

FOREIGN PATENT DOCUMENTS

| | | | |
|---|---|---|---|
| 2238836 | 8/1972 | Fed. Rep. of Germany | 272/63 |

*Primary Examiner*—William R. Browne
*Attorney, Agent, or Firm*—Holman & Stern

[57] ABSTRACT

A tensioning device for a rope bracing system which is formed by an anchored bight forming two rope sections with the two ends of the rope being fixed to the points to be braced. The device comprising a clamping sleeve with a regular trapezoidal prismatic guide slot which holds the two rope sections and a wedge shaped to fit into the slot holding the rope sections against the side walls of the slot. The smaller end opening of the slot faces the points to be supported.

2 Claims, 4 Drawing Figures

TENSIONING DEVICE FOR A GYMNASTICS APPARATUS

The instant invention concerns a tensioning device for ropes or cables and, more particularly, for bracing ropes for a gymnastics apparatus.

Gymnastics apparatuses are generally provided with rope anchoring for lateral bracing in addition to the structural sidesupports to maintain the necessary rigidity. Tension is kept on the ropes by various means, hereafter referred to as rope devices. These rope devices each enclose two pull rope sections forming a bight, one end of which is fastened to the lateral support while the other end is positioned at an adjustment means. The adjustment means is fastened to one end of an anchor rope section. The other end of the anchor rope section is fastened to the floor. The gymnastics apparatus could be, for example, a set of horizontal bars, whereby the two lateral supports of the bars are formed by one each bar column. As changes are made in the positioning of the bars, the bracing ropes must be adjusted.

In a prior art device for establishing and maintaining tension on the ropes (German Pat. No. 2,238,836), the tensioning device of one rope device has two parts. The first is a turnbuckle, which is provided in the anchor rope section which runs between the floor and the adjusting means. The second consists only of the tensioning or clamping sleeve which with the narrow end of a guide slot faces the adjusting means. This clamping sleeve is arranged in various positions on the pull rope bight sections in the area where it is automatically locked by friction, and therefore eliminates the necessity for a mechanism for fastening the clamping sleeve to the pull rope bight sections. This prevents any damage to the ropes themselves. If in the prior art tensioning device the spar gap of the bars in a gymnastics apparatus of horizontal bars should be changed, the tension produced by the positioning of the rope device must be first released, and then again reinstated. Preferably, this should be accomplished by means of displacing only the clamping sleeve. However, practice has shown, spar gap changes of the horizontal bars can be accomplished by means of the clamping sleeve only for relatively short distances and relatively small distance changes. If there exists the desire for a large increase in the distances between the bars, problems result. At increasing distances of the horizontal bars, the clamping sleeve no longer securely holds the ropes by means of its automatic friction locking. In addition, when greater gaps between the horizontal bars are desired, an adjustment must be made on the turn-buckle which is in the anchor rope section. This is time-consuming and cumbersome.

It is an object of the instant invention to provide a tensioning device of the above-mentioned type, in which tensioning of the bracing ropes can be accomplished by means of only the tensioning or clamping sleeve even when greater adjusting distances of the bars are desired, and the clamping sleeve is mountable on the pull rope bight sections without causing damage to the pull ropes. It is also an object of the instant invention to obtain a more speedy changing of the spar gaps. The attaching of the clamping sleeve to the pull rope bight sections should be made without interference by the pull rope sections.

The instant invention provides for a tensioning element of the above-mentioned type, characterized in that a wedge, which narrows in shape in the direction of the lateral support, is pushed between the two pull rope bight sections which are holding a clamping sleeve and the clamping sleeve faces the lateral support with the narrow end of the guide slot.

The clamping sleeve, also under a strongly increasing gap of the horizontal bars, is now pushed on the pull rope sections far enough in the direction towards the bar supports so that the required tension is produced. Thereafter, the wedge is pushed into the clamping sleeve, whereby the pull rope sections are pressed against the clamping sleeve, so that the clamping sleeve is unable to slide back into the direction of the adjusting means. By means of the inventive mounting of the clamping device of the pull rope sections, no damage to the pull rope sections occurs since the wedge along one section of the pull rope sections abuts on the same and thus only pushes the same against the clamping sleeve.

It is possible to construct the tensioning element of both rope directions as a clamping sleeve with a wedge. Since both rope devices are each provided with the clamping sleeve with the wedge instead of a turn buckle, there is no longer a need operating the turn buckle in order to change the distance between the horizontal exercising bars, thus, distances between the bars can be made within a much shorter period of time. The instant invention eliminates the need for a turn buckle to be provided at any of the four rope devices of an exercising horizontal bar set, and provides instead a clamping sleeve on each of the pull rope bight sections which are arranged on each of the two lateral supports.

The inventive tensioning device can be utilized not only for bracing or tensioning the two pairs of bar supports of an exercising horizontal bar set, but it may also be utilized, for example, for bracing the two columns of a horizontal bar exercising apparatus. On the basis of the instant invention, the need for mounting a tension-load testing instrument in each rope device is eliminated. Due to the wedge, the clamping sleeve is unable to become loosened during the use of the gymnastics bars, it is no longer necessary to continuously monitor and control the stress of each rope device with the aid of a tension load testing instrument.

The instant invention additionally proposes that the wedge be provided with a grip means having guide grooves provided thereon into which the pull rope sections are held. The walls of the grooves extend beyond the pull rope sections. When the wedge needs to be pulled out of the clamping sleeve, the mover's hand covers the pull rope sections in the area of the grip means whereby the hand engages the groove-walls without touching the pull rope sections. Thus, the wedge can be pulled from the clamping sleeve without any chance of injuries to the hand from the pull rope sections.

The instant invention proposes further that the grip means be provided at the wider side of the wedge. This produces a more compact formation of the unit consisting of the wedge and the grip means. In this construction, wedge and clamping device are separated from each other by pulling apart the handle or grip means and the clamping sleeve.

The drawings illustrate a preferred embodiment of the instant invention, wherein.

Figure 4:
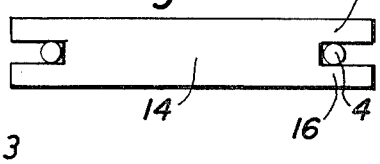
FIG. 4 illustrates an end view of FIG. 2.
Figure 1:
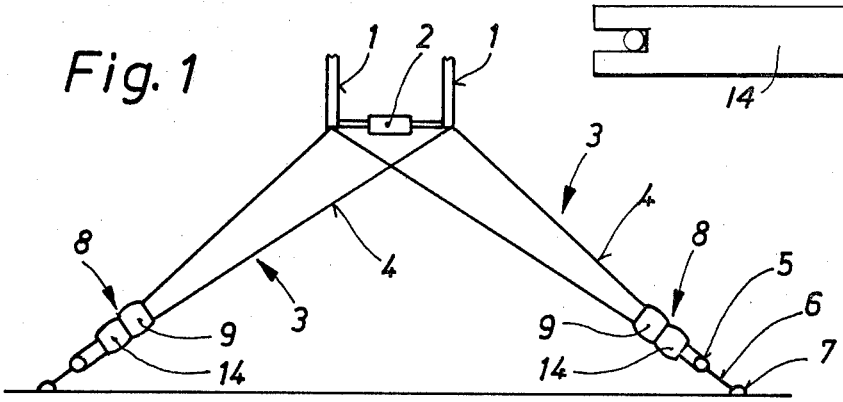
FIG. 1 represents a top view of one half section of a set of horizontal gymnastic bars, with the tensioning devices.

A set of gymnastics horizontal bars is shown in FIG. 1, comprising two horizontal bars 1, parallel to each other, which bars often are arranged at varying heights. At each end of each of said bars 1 there is provided a longitudinally adjustable bar support (not shown) over which the bars are supported on the floor. Two each of the bar supports form one of the two lateral supports of the bar. The bar supports are jointedly mounted on the floor, so that the two bar supports at one side of the gymnastics horizontal bars below, on the floor, can have a different distance from that of the bars above. In order to change the distance between the two bars 1, a longitudinally-adjustable adjusting means 2 is provided at each side of the gymnastics bars, whereby the ends of said adjusting means 2 are fastened on the bar supports. There are two rope sections 3 forming a bight provided at each side of the exercising bars which engage the upper ends of the bar supports, forming together an angle and running downward to the floor. Each rope guide is provided with a rope having its two ends fastened to the two bar supports and comprising two pull rope sections 4 which together form a bight, whereby said pull rope sections 4 merge in an adjusting device 5 in the form of a pulley. The pulley 5 is fastened to one end of an anchor rope section 6; the other end of which is fastened at one point 7 on the floor.

Figure 3:
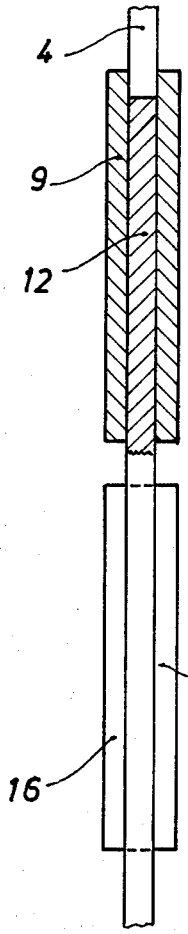
FIG. 3 illustrates a cross-sectional view according to line III—III of FIG. 1.
Figure 2:
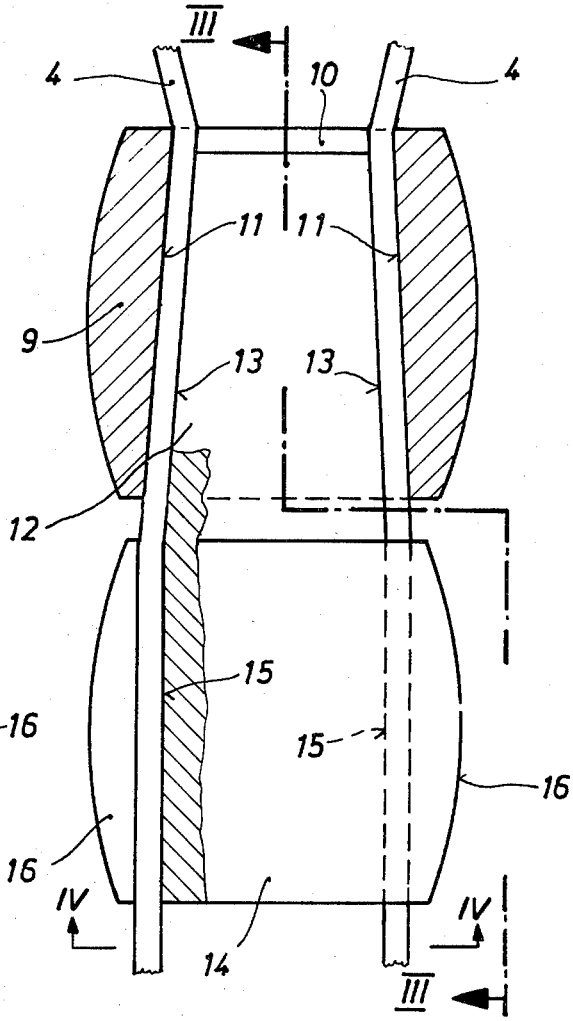
FIG. 2 is a top view of a clamping sleeve with a wedge, with partial cross-sectional views.

Between the adjusting device 5 and the point 7, there is proposed only the anchor rope 6 but no turn buckle. It is thus possible to keep the distance between adjusting device 5 and point 7 very short. This decreases the angle between the two pull rope sections 4. Between the adjusting device 5 and the supports of the two horizontal bars, there is arranged a tensioning element 8 holding both sides of the pull rope sections 4, which tensioning element 8, depending on the distance of the two bars 1 from each other, is arranged with a varying distance from the adjusting device 5. The tensioning element 8, according to FIGS. 2 and 3, comprises a clamping sleeve 9, which is provided with a flat guide slot 10, through which are guided the two pull rope sections 4. Each pull rope section 4 abuts one of the sides 11 of the guide slot, and the distance of the two narrow sides 11 decreases continuously in the direction toward the bar supports, so that the guiding slot 10 is of trapezoidal form. The top 17 and bottom 18 of the guide slot 10 run parallel to each other with a distance which corresponds approximately with the diameter of the pull rope sections.

The tensioning element 8 further comprises a wedge 12 having a form which is adapted to the shape of the guide slot 10. The wedge 12 is blunt, thus having no pointed end, and has a length corresponding approximately with the length of the guide slot 10. The top and bottom of the wedge are parallel to each other. The edges 13 run at an angle towards each other, which angle corresponds approximately with the angle at which the sides 11 of the guide slot 10 run towards each other. The wedge narrows in its width in the direction of the bar, namely, conically. When the wedge 12 is completely pushed into the guide slot 10, the lateral distance between the edges 13 of the wedge and the sides 11 of the slot is smaller than the diameter of the pull rope sections 4. The wedge, when fixedly clamping the pull rope sections 4, thus protrudes with its wider end to some extent from the guide slot 10.

At the wider side of the wedge 12, a handle means 14 is provided, which is connected with the wedge and with which the wedge is integrally attached. The handle means 14 extends between the two pull rope sections 4 in the direction of the adjusting device 5 and is provided at its edges with guiding grooves 15 which are formed by means of two groove walls 16. The two guide grooves 15 run approximately parallel to each other, thus the two pull rope sections between the clamping sleeve and the adjustment device also run parallel to each other. The two groove walls 16 are at a distance from each other which corresponds approximately with the diameter of the pull rope sections 4. The depth of the guide groove 15 is larger than the diameter of the pull rope sections 4.

What I claim is:

1. A gymnastics apparatus including two supports to be braced, an anchoring point on the floor, two rope sections, one end of each rope section being fixed to one of the supports, the other end of each rope section being unadjustably fixed to the anchoring point thereby forming an angle opening away from the anchoring point, and a tensioning device slidably mounted on the two rope sections;

the tensioning device comprises: a tensioning sleeve having a guide slot extending therethrough, said slot having side walls, a small end opening, and a large end opening, both of the rope sections running through said slot, said large end opening being oriented towards said anchoring point; and a wedge having edges, a small end, a large end, and handle means for handling said wedge, adapted to fit into said guide slot between the rope sections pressing the rope sections against said side walls of the said guide slot, said handle means having handle edges, said handle edges being provided with guide grooves with groove walls in which said rope sections are guided, said groove walls extending outwardly beyond said rope sections.

2. The apparatus of claim 1, wherein said handle means is fixed to said large end of said wedge.

* * * * *